US005750486A

United States Patent [19]

Ibanez et al.

[11] Patent Number: 5,750,486

[45] Date of Patent: May 12, 1998

[54] LOW-FOAMING CLEANING FORMULATIONS

[75] Inventors: Pilar Ibanez, Barcelona; Jaume Josa, Terrassa; Miguel Osset, Barcelona, all of Spain

[73] Assignee: Henkel Kommanditgesellschaft auf Aktien, Duesseldorf, Germany

[21] Appl. No.: 624,588

[22] PCT Filed: Sep. 29, 1994

[86] PCT No.: PCT/EP94/03255

§ 371 Date: Jul. 5, 1996

§ 102(e) Date: Jul. 5, 1996

[87] PCT Pub. No.: WO95/10586

PCT Pub. Date: Apr. 20, 1995

[30] Foreign Application Priority Data

Oct. 8, 1993 [DE] Germany ..... 43 34 368.6

[51] Int. Cl.[6] ..... C11D 1/835

[52] U.S. Cl. ..... 510/356; 510/360; 510/504; 510/506; 510/423

[58] Field of Search ..... 510/504, 515, 510/506, 356, 360, 329, 330, 423

[56] References Cited

U.S. PATENT DOCUMENTS

| | | | |
|---|---|---|---|
| 4,088,598 | 5/1978 | Williams | 252/135 |
| 4,335,024 | 6/1982 | Hennemann et al. | 252/545 |
| 4,443,363 | 4/1984 | Klinger et al. | 252/547 |
| 4,540,505 | 9/1985 | Frazier | 252/106 |
| 4,597,887 | 7/1986 | Colodney et al. | 252/106 |
| 4,652,392 | 3/1987 | Baginski et al. | 252/109 |
| 4,678,605 | 7/1987 | Geke et al. | 252/547 |
| 4,756,849 | 7/1988 | Weber et al. | 252/542 |
| 4,832,863 | 5/1989 | Trabitzsch et al. | 252/135 |
| 5,004,556 | 4/1991 | Julemont et al. | 252/99 |
| 5,635,467 | 6/1997 | Staley | 510/349 |

FOREIGN PATENT DOCUMENTS

| | | |
|---|---|---|
| 0004121 | 9/1979 | European Pat. Off. . |
| 0005850 | 12/1979 | European Pat. Off. . |
| 0044003 | 1/1982 | European Pat. Off. . |
| 0054895 | 6/1982 | European Pat. Off. . |
| 0342997 | 11/1989 | European Pat. Off. . |
| 209650 | 3/1984 | German Dem. Rep. . |
| 3124210 | 12/1982 | Germany . |
| 3644808 | 7/1988 | Germany . |
| WO9103536 | 3/1991 | WIPO . |

*Primary Examiner*—Douglas J. McGinty
*Assistant Examiner*—John R. Hardee
*Attorney, Agent, or Firm*—Ernest G. Szoke; Wayne C. Jaeschke; Real J. Grandmaison

[57] ABSTRACT

A process for increasing the viscosity of a low-foaming, polymer-free cleaning composition containing cationic surfactants, by adding to the composition a nonionic surfactant mixture consisting essentially of a) fatty alcohol polyethylene glycol ethers corresponding to formula (I):

$$R^1O—(CH_2CH_2O)_mH \quad (I)$$

in which $R^1$ is a linear alkyl or alkenyl radical containing 12 to 18 carbon atoms and m is a number of 1 to 10, and b) oxoalcohol polyethylene glycol ethers corresponding to formula (II):

$$R^2O—(CH_2CH_2O)_nH \quad (II)$$

in which $R^2$ is a linear and branched alkyl radical containing 11 to 15 carbon atoms and n is a number of 1 to 10, wherein component a) and component b) are present in a ratio by weight of 1:3 to 3:1.

6 Claims, No Drawings

LOW-FOAMING CLEANING FORMULATIONS

BACKGROUND OF THE INVENTION

1. Field of the Invention

This invention relates to low-foaming cleaning formulations based on cationic surfactants which contain mixtures of linear and branched alcohol ethoxylates as self-thickening nonionic surfactant components.

2. Discussion of Related Art

Formulations for cleaning hard non-textile surfaces occurring in the home and in the institutional sector, except for crockery, are generally known as multipurpose cleaners (MPC's). Low-foaming MPC's are those which, when manually applied, generate a minimal volume of foam which undergoes a significant further reduction within a few minutes.

Formulations of the type in question have long been known and are established on the market. They are essentially aqueous surfactant solutions of various kinds with or without additions of builders, hydrotropes or solvents. Besides the required cleaning effect, a disinfecting effect is often required so that formulations of the type in question normally contain cationic surfactants, especially those containing two long and two short alkyl chains, as active substances.

Although some foaming of the in-use solution is required by the user at the beginning of cleaning as a sign of effectiveness, the foam should soon collapse so that surfaces once cleaned do not have to be rewiped. To this end, formulations of the type mentioned normally contain low-foaming nonionic surfactants, for example mixed ethers or alcohol alkoxylates, more particularly oxoalcohol ethoxylates.

Unfortunately, multipurpose cleaners based on cationic surfactants and alcohol ethoxylates are difficult to thicken. Considerable quantities of carboxymethyl cellulose, fatty acid alkanolamides and/or electrolyte salts normally have to be added to control viscosity although viscosity regulators such as these can adversely affect the property profile of the formulation. In addition, stability in storage is not always satisfactory, especially in the event of variations in temperature.

Accordingly, the problem addressed by the present invention was to provide low-foaming cleaning formulations based on cationic surfactants which would be free from the disadvantages mentioned above.

DESCRIPTION OF THE INVENTION

The present invention relates to low-foaming cleaning formulations based on cationic surfactants which are characterized in that they contain mixtures of a) fatty alcohol polyethylene glycol ethers corresponding to formula (I):

$$R^1O—(CH_2CH_2O)_mH \quad (I)$$

in which $R^1$ is a linear alkyl and/or alkenyl radical containing 12 to 18 carbon atoms and m is a number of 1 to 10 and b) oxoalcohol polyethylene glycol ethers corresponding to formula (II):

$$R^2O—(CH_2CH_2O)_mH \quad (II)$$

in which $R^2$ is a linear and/or branched alkyl radical containing 11 to 15 carbon atoms and n is a number of 1 to 10, as self-thickening nonionic surfactant components.

It has surprisingly been found that the formulations according to the invention are not only low-foaming and have an excellent cleaning and disinfecting effect, they also show sufficiently high viscosity, even in the absence of typical thickeners, through the addition of the selected nonionic surfactant mixture and retain this viscosity, even in the event of prolonged storage.

Cationic surfactants

The cationic compounds typically used are so-called quaternary ammonium compounds, i.e. derivatives of the ammonium ion preferably containing two long and two short alkyl chains, such as dimethyl distearylammonium chloride for example. Quaternary benzylammonium compounds corresponding to formula (III):

$$[R^3—\overset{\overset{R^4}{|}}{\underset{\underset{R^5}{|}}{\overset{+}{N}}}—CH_2—Ph]X^- \quad (III)$$

in which $R^3$ and $R^4$ independently of one another represent an optionally hydroxy-substituted alkyl radical containing 1 to 4 carbon atoms, $R^5$ is an alkyl and/or alkenyl radical containing 12 to 22 carbon atoms, Ph is a phenyl radical and X is halide, are preferably used. Typical examples of such compounds are dimethyl dodecyl benzylammonium chloride and bromide. The multipurpose cleaners according to the invention may contain the cationic surfactants in quantities of 1 to 5% by weight and preferably 2 to 3% by weight, based on the formulation.

Nonionic surfactants

According to the invention, the nonionic surfactants are used as a self-thickening mixture of strictly linear fatty alcohol EO adducts and more or less highly branched oxoalcohol EO adducts. Both types of ethoxylate are known substances which are industrially produced by the base-catalyzed ethoxylation of primary alcohols. The ethoxylates may have a conventional homolog distribution or a narrow homolog distribution, depending on the catalysts used.

Accordingly, addition products of, on average, 1 to 10 moles of ethylene oxide with fatty alcohols containing 12 to 18 carbon atoms may be used as component a). Fatty alcohol polyethylene glycol ethers corresponding to formula (I) in which $R^1$ is an alkyl radical containing 12 to 14 carbon atoms and m is a number of 1 to 4, are preferably used. Typical examples are adducts of 2, 3 or 4 moles of ethylene oxide with lauryl alcohol or technical $C_{12/14}$ cocofatty alcohol.

Adducts of, on average, 1 to 10 moles of ethylene oxide with oxoalcohols containing 11 to 15 carbon atoms are suitable for use as component b). "Oxoalcohols" are primary alcohols which are prepared by hydrogenation of aldehydes from Roelen's oxosynthesis and which normally contain from 15 to 25% by weight of branched homologs. Oxoalcohol polyethylene glycol ethers corresponding to formula (II), in which $R^2$ is an alkyl radical containing 11 to 13 carbon atoms and m is a number of 5 to 10, are preferably used. Typical examples are the adducts of 5, 7 or 9 moles of ethylene oxide with a technical $C_{11/13}$ oxoalcohol cut.

The low-foaming cleaning formulations may contain the polyethylene glycol ethers corresponding to formulae (I) and (II) in a ratio by weight of 1:3 to 3:1 and preferably in a ratio by weight of 1:2 to 2:1. The total percentage content of polyethylene glycol ethers may be from 5 to 10% by weight and is preferably from 6 to 8% by weight, based on the formulation.

Auxiliaries and additives

The low-foaming cleaning formulations according to the invention may contain other typical ingredients.

These include, for example, solubilizers, such as ethanol, isopropyl alcohol, ethylene glycol, diethylene glycol or preferably butyl diglycol; foam regulators, such as for example soaps or mixed ethers; and soluble builders, such as for example citric acid or sodium citrate, EDTA or NTA. These additives may make up from 1 to 8% by weight and preferably from 4 to 6% by weight of the formulations.

The formulations are preferably alkalized by addition of sodium hydroxide and/or soda, a pH value in the range from 9 to 10 being preferred. The active substance content of the formulations may be from 20 to 80% by weight and depends on whether it is desired to obtain a concentrate which is diluted to the in-use concentration by the user before cleaning or whether a correspondingly diluted formulation is to be marketed. In the latter case, the active substance content is typically of the order of 20% by weight. To produce the formulations, the starting materials merely have to be mixed purely mechanically, optionally at elevated temperature; no chemical reaction is involved.

Commercial Applications

The new cleaning formulations are low-foaming, have a powerful cleaning effect and are stable in storage. The addition of the nonionic surfactant mixture provides them with a sufficiently high viscosity which otherwise could only be established by the addition of thickeners.

Accordingly, the present invention relates to the use of mixtures containing a) fatty alcohol polyethylene glycol ethers corresponding to formula (I):

$$R^1O—(CH_2CH_2O)_mH \quad (I)$$

in which $R^1$ is a linear alkyl and/or alkenyl radical containing 12 to 18 carbon atoms and m is a number of 1 to 10 and b) oxoalcohol polyethylene glycol ethers corresponding to formula (II):

$$R^2O—(CH_2CH_2O)_nH \quad (II)$$

in which $R^2$ is a linear and/or branched alkyl radical containing 11 to 15 carbon atoms and n is a number of 1 to 10, as nonionic thickeners for low-foaming cleaning formulations based on cationic surfactants.

The following Examples are intended to illustrate the invention without limiting it in any way.

EXAMPLES

I. Formulations

TABLE 1

Formulations according to the invention and comparison formulations
Percentages as % by weight, water to 100% by weight

| Components | F1 % | F2 % | F3 % | F4 % | F5 % |
|---|---|---|---|---|---|
| Dehyquart LDB 50 | 2.5 | 2.5 | 2.5 | 2.5 | 1.5 |
| Dehydol LS 4 | 6.0 | 6.0 | — | 6.0 | — |
| Lutensol AO 7 | 2.0 | 6.0 | 8.0 | — | 4.0 |
| Butyl diglycol | 2.0 | 2.0 | 2.0 | 2.0 | 2.0 |
| Nitrilotriacetate | 0.8 | 0.8 | 0.8 | 0.8 | 0.8 |
| Edenor KPK 12–18 | 0.5 | 0.5 | 0.5 | 0.5 | 0.5 |
| Sodium carbonate | 0.5 | 0.5 | 0.5 | 0.5 | 0.5 |
| Sodium citrate | 0.1 | 0.1 | 0.1 | 0.1 | 0.1 |

| | | |
|---|---|---|
| Dehyquart ® LDB 50 | = | Dimethyl dodecyl benzylammonium chloride, Henkel KGaA, Düsseldorf |
| Dehydol ® LS 4 | = | $C_{12/14}$ fatty alcohol 4 EO adduct, Henkel KGaA, Düsseldorf, FRG |
| Lutensol ® AO 7 | = | $C_{13/15}$ oxoalcohol 7 EO adduct, BASF AG, Ludwigshafen, FRG |
| Edenor ® KPK 12–18 | = | Coconut oil/palm kernel oil fatty acid Na salt, Henkel KGaA, Düsseldorf, FRG |

II. Viscosity measurements

The viscosity of formulation F1 according to the invention and comparison formulations F2 to F5 were determined with a Brookfield viscosimeter (Model RCT, spindle No. 1, 12 r.p.m.) after storage at 40° C. for 24 hours and for 2, 8, 12 and 26 weeks. The results are set out in Table 2:

TABLE 2

Viscosity measurements

| | | Viscosity (mPa · s) | | | | |
|---|---|---|---|---|---|---|
| Ex. | Formulation | 24 h | 2 w | 8 w | 12 w | 26 w |
| 1 | F1 | 80 | 85 | 85 | 85 | 80 |
| C1 | F2 | 50 | 40 | 40 | 40 | 40 |
| C2 | F3 | 50 | 40 | 40 | 35 | 35 |
| C3 | F4 | 50 | 40 | 40 | 35 | 35 |
| C4 | F5 | 50 | 35 | 35 | 35 | 30 |

What is claimed is:

1. A low-foaming cleaning composition free of polymers consisting essentially of 1% to 5% by weight of cationic surfactants and 5% to 10% by weight of a viscosity-increasing nonionic surfactant mixture consisting essentially of a) fatty alcohol polyethylene glycol ethers corresponding to formula (I):

$$R^1O—(CH_2CH_2O)_mH \quad (I)$$

in which $R^1$ is a linear alkyl or alkenyl radical containing 12 to 18 carbon atoms and m is a number of 1 to 10, and b) oxoalcohol polyethylene glycol ethers corresponding to formula (II):

$$R^2O—(CH_2CH_2O)_nH \quad (II)$$

in which $R^2$ is a linear and branched alkyl radical containing 11 to 15 carbon atoms and n is a number of 1 to 10, wherein said polyethylene glycol ethers corresponding to formulae (I) and (II) are present in a ratio by weight of 1:3 to 3:1, all weights being based on the weight of said composition, said cationic surfactants comprising quartenary benzylammonium compounds corresponding to formula (III):

$$(R^3-\overset{R^4}{\underset{R^5}{\overset{|}{\underset{|}{\overset{+}{N}}}}}-CH_2-Ph)X^- \quad \text{(III)}$$

in which $R^3$ and $R^4$ independently of one another represent an optionally hydroxy-substituted alkyl radical containing 1 to 4 carbon atoms, $R^5$ is an alkyl or alkenyl radical containing 12 to 22 carbon atoms, Ph is a phenyl radical and X is halide.

2. A low-foaming cleaning composition as in claim 1 wherein in said fatty alcohol polyethylene glycol ethers corresponding to formula (I), $R^1$ is an alkyl radical containing 12 to 14 carbon atoms and m is a number of 1 to 4.

3. A low-foaming cleaning composition as in claim 1 wherein in said oxoalcohol polyethylene glycol ethers corresponding to formula (II), $R^2$ is an alkyl radical containing 11 to 13 carbon atoms and n is a number of 5 to 10.

4. The process of increasing the viscosity of a low-foaming, polymer-free cleaning composition consisting essentially of 1% to 5% by weight of cationic surfactants, comprising adding to said composition from 5% to 10% by weight of a nonionic surfactant mixture consisting essentially of a) fatty alcohol polyethylene glycol ethers corresponding to formula (I):

$$R^1O-(CH_2CH_2O)_mH \quad \text{(I)}$$

in which $R^1$ is a linear alkyl or alkenyl radical containing 12 to 18 carbon atoms and m is a number of 1 to 10, and b) oxoalcohol polyethylene glycol ethers corresponding to formula (II):

$$R^2O-(CH_2CH_2O)_nH \quad \text{(II)}$$

in which $R^2$ is a linear and branched alkyl radical containing 11 to 15 carbon atoms and n is a number of 1 to 10, said component a) and component b) being present in a ratio by weight of 1:3 to 3:1, all weights being based on the weight of said composition, and wherein said cationic surfactants comprise quaternary benzylammonium compounds corresponding to formula (III):

$$(R^3-\overset{R^4}{\underset{R^5}{\overset{|}{\underset{|}{\overset{+}{N}}}}}-CH_2-Ph)X^- \quad \text{(III)}$$

in which $R^3$ and $R^4$ independently of one another represent optionally hydroxy-substituted alkyl radical containing 1 to 4 carbon atoms, $R^5$ is an alkyl or alkenyl radical containing 12 to 22 carbon atoms, Ph is a phenyl radical and X is halide.

5. A process as in claim 4 wherein in said fatty alcohol polyethylene glycol ethers corresponding to formula (I), $R^1$ is an alkyl radical containing 12 to 14 carbon atoms and m is a number of 1 to 4.

6. A process as in claim 4 wherein in said oxoalcohol polyethylene glycol ethers corresponding to formula (II), $R^2$ is an alkyl radical containing 11 to 13 carbon atoms and n is a number of 5 to 10.

* * * * *